United States Patent [19]

Lyons

[11] Patent Number: 4,553,611

[45] Date of Patent: Nov. 19, 1985

[54] PRESSURE DROP REGULATOR FOR DOWNHOLE TURBINE

[76] Inventor: William C. Lyons, P.O. Box 2457, Santa Fe, N. Mex. 87504-2457

[21] Appl. No.: 602,396

[22] Filed: Apr. 20, 1984

[51] Int. Cl.[4] ..... F03B 13/02; E21B 4/02

[52] U.S. Cl. ..... 175/71; 175/100; 175/107

[58] Field of Search ..... 175/71, 103, 100, 107; 415/503, 502

[56] References Cited

U.S. PATENT DOCUMENTS

| | | | |
|---|---|---|---|
| 3,766,992 | 10/1973 | Tiraspolsky et al. | 415/502 X |
| 3,802,515 | 4/1974 | Flamand et al. | 415/502 X |
| 3,882,946 | 5/1975 | Ioannesian et al. | 415/502 X |
| 3,966,369 | 6/1976 | Garrison | 175/107 X |
| 3,982,859 | 9/1976 | Tschirky et al. | 175/320 X |
| 4,339,007 | 7/1982 | Clark | 175/107 |

*Primary Examiner*—Stephen J. Novosad
*Assistant Examiner*—Bruce M. Kisliuk
*Attorney, Agent, or Firm*—James E. Snead; Marcus L. Bates

[57] ABSTRACT

In a borehole forming operation, the flow of gas through a downhole pneumatic motor is regulated to eliminate horsepower variations due to variations in bottom hole pressure. The pneumatic motor is connected to the lower end of a tubing string and an orifice is placed within the entrance and exit gas passageways leading to and from the pneumatic motor. The uphole source (i.e., compressors) of gas pressure and gas flow rate is maintained as a constant value which assures that sonic flow conditions exist at the lower orifice. The employment of gauged orifices placed within the inlet and exit passageways of the gas motor assures that sonic flow conditions exist at the lower orifice and as the bottom hole pressure varies, there is no resultant change in the motor output horsepower since constant flow rate and pressure drop ratio through the motor is maintained. This is the case so long as the bottom hole pressure does not increase to the critical ratio.

11 Claims, 3 Drawing Figures

PRESSURE DROP REGULATOR FOR DOWNHOLE TURBINE

BACKGROUND OF THE INVENTION

It is advantageous to employ a downhole pneumatic motor for drilling boreholes, especially when encountering rock formations which can be drilled more economically with air and gas techniques. In my previous patents, U.S. Pat. No. 4,432,423 and U.S. Pat. No. 4,434,862 there is disclosed a downhole pneumatic motor connected to the lower end of a non-rotating drill string which rotates a drill bit through a reduction gear system. Reference is made to my previously filed patents for further background of the present invention.

The downhole pneumatic motor is actuated by compressed air or gas which usually is supplied to the drill string via surface compressor systems. The downhole pneumatic motor converts the internal energy and kinetic energy of the air or gas flow under pressure to mechanical energy in the form of a rotating shaft. For the pneumatic motor to operate at a specific horsepower level, the air or gas flow through the motor and the pressure drop ratio across the motor must be maintained at a prescribed magnitude. In most air or gas pneumatic motor applications, the exhaust of the spent air or gas is to local atmospheric conditions. The atmospheric pressure conditions are not variable; therefore, by maintaining a constant injection pressure and flow rate to the motor, the horsepower output of the motor can be maintained. However, for a downhole pneumatic motor, the spent air or gas exits to the annulus at the bottom of the hole. The back pressure on the air or gas exiting the downhole pneumatic motor is partially the result of the friction losses in the flow stream as the air or gas moves up the annulus. Also, the spent air or gas is required to lift rock cuttings from the bottom of the hole. Because of these factors, the bottomhole pressure can vary depending upon the amount of rock cuttings that is in the annulus return air or gas flow, or whether formation water has entered the annulus and must also be carried to the surface by the return air or gas flow.

If the exit (for air or gas flow) from the downhole pneumatic motor were exposed to these variations in bottom hole pressure, the pressure drop ratio through the downhole pneumatic motor will vary and therefore vary the horsepower output of the motor itself. This would in turn affect the mechanical power to the drill bit and thereby the drilling efficiency.

This disclosure teaches method and apparatus by which the mass flow rate and pressure drop ratio through a downhole pneumatic motor are maintained constant as the bottom hole pressure varies, and therefore, the horsepower output of the downhole pneumatic motor is maintained constant.

SUMMARY OF THE INVENTION

A downhole pneumatic motor is connected to a non-rotating pipe string. The motor output shaft is connected to rotate a drill bit. A suitable source of gas flow and pressure is connected to the upper end of the pipe string and thereby provides power fluid for the motor. The spent gas exiting from the motor is conducted through the drill bit and acts as drilling fluid as the spent gases lift the formation cuttings uphole through the borehole annulus and to the surface of the earth.

An upper and lower orifice means are placed in series relationship within the gas flow path. The two orifices are separated from one another by the pneumatic motor. The upper orifice means is of a size to assure that the required pressure drop takes place into the motor. The lower orifice is of a size to assure only sonic flow therethrough and to the drill bit. It should be noted that the bit orifices can be used as the lower orifice. Accordingly, so long as the supply gas flow rate and pressure are maintained above a minimum value, and the bottom hole borehole pressure does not increase to the critical ratio established by the sonic flow through the lower orifice, the motor delivers a constant horsepower output.

The method of the present invention is carried out by providing an upper orifice means by which a first pressure differential is effected between the gas motor inlet and the source of gas pressure to cause subsonic or sonic flow to occur into the motor. The downstream flow passageway from the motor is provided with a lower orifice means by which a second pressure differential is effected between the motor outlet and the drill bit outlet to cause sonic flow to occur through the bit orifices as spent gas exhausts into the borehole annulus. Hence, the pressure of the compressible fluid flowing down the pipe string is therefore maintained at a minimum value required to achieve sonic flow conditions at the location of the second pressure differential (i.e., the lower orifice).

In one embodiment of the invention, an upper orifice is provided immediately upstream of the gas motor, and a lower orifice is positioned downstream of the gas motor. The latter orifice can be made up of orifices in the drill bit itself. The ratio of the diameters of the orifice throats are of a value respective to the bottomhole borehole pressure and the pipe string pressure to achieve a required pressure drop at the upper orifice and sonic flow conditions at the lower orifice.

In the practical embodiment of the invention, individual upstream orifices are incorporated into each of the inlets to the motor, while each of the passageways through the bit are provided with an orifice means therewithin. The accumulated total area of the upper orifice respective to the accumulated total area of the lower orifice are sized respective to one another to achieve a ratio which effects sonic flow below the pneumatic motor regardless of variations in the bottom hole pressure.

Accordingly, a primary object of the present invention is the provision of means by which sonic flow conditions always occur at the lower orifice below the downhole pneumatic motor while the bottom hole pressure is free to change within a predetermined range of values.

Another object of the present invention is the provision of a drill string having a pneumatic motor supported at the lower end thereof connected to rotate a drill bit while gas flows down a pipe string to the motor, with means being provided whereby subsonic or sonic flow conditions occur at the entrance of the motor and sonic conditions occur at the exit of the motor to thereby cause the motor to extract a constant amount of work from the gases flowing through the pipe string.

A further object of this invention is the provision of a downhole expansion motor having orifice means associated therewith for regulating gaseous flow therethrough to thereby provide constant horsepower output thereof, with said orifice means being positioned within the entrance and outlet flow passageways leading to and from the motor.

A still further object of this invention is the provision of flow control means positioned within the entrance and exit passageways of a downhole pneumatic motor wherein the flow control means and motor supply pressure are adjusted respective to one another to provide a constant pressure drop ratio through the motor.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
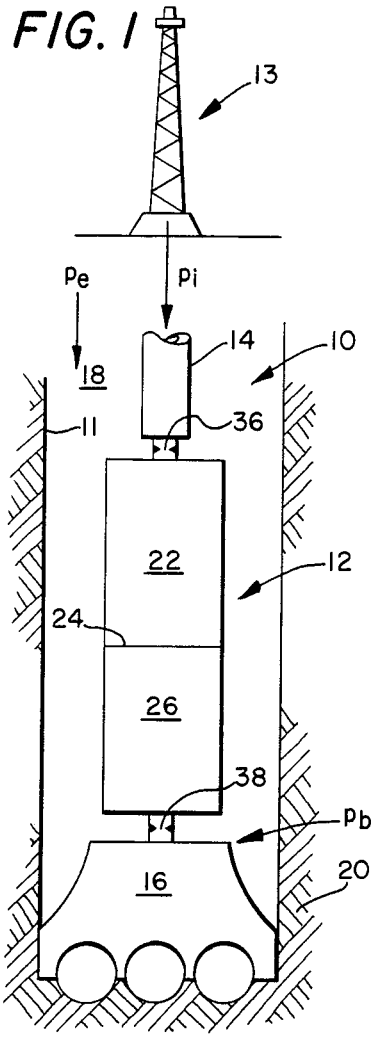
FIG. 1 is a fragmentary, part schematical, part diagrammatical, part longitudinal, cross-sectional view which sets forth the method of the present invention.

In FIG. 1 of the drawings, there is disclosed a drill string 10 located within a borehole 11, and having a drill motor housing 12 affixed to the lower end of a pipe string 14. A drill bit 16 forms the lower terminal end of the drill string. Borehole annulus 18 is formed between the inner wall of the borehole 11 and the outer wall of the pipe string 14. The borehole extends through a geological formation 20.

Figure 2:
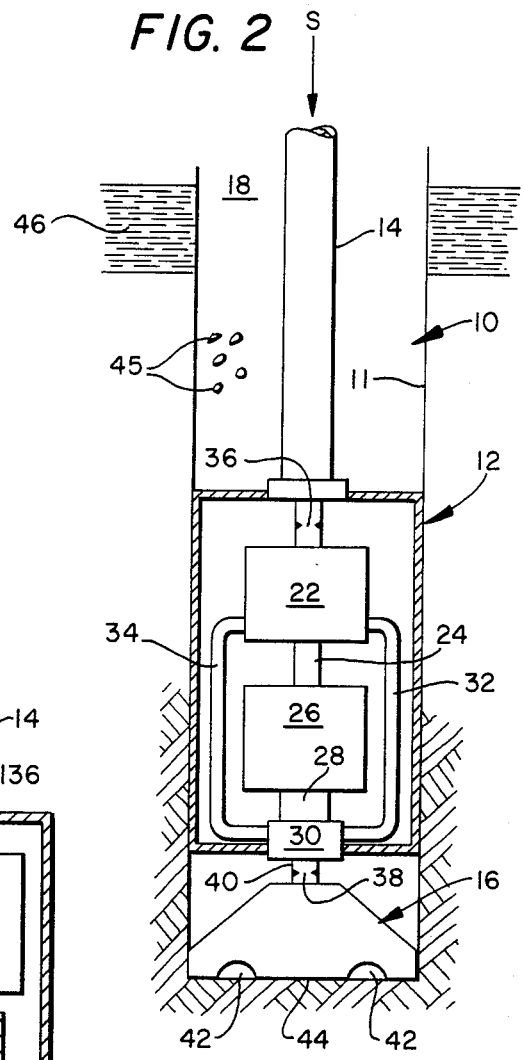
FIG. 2 is a broken longitudinal, part cross-sectional view of a borehole having a drill string therein made in accordance with the present invention; and, FIG. 3 is a part diagrammatical, part schematical, part longitudinal, cross-sectional view of a drill string made in accordance with the present invention.

As seen in FIG. 2, a pneumatic motor 22 has an output shaft 24 thereof connected to a gear reduction system 26, which in turn is connected to rotate an output shaft 28. A swivel 30 enables spent gases from conduits 32 and 34 to enter the interior of the output shaft 28. An orifice means 36 is connected within the gas supply entrance to the pneumatic motor 22, while a lower orifice means 38 is connected within the spent gas outlet 40 at the downstream side of the motor 22.

More specifically, the drill bit 16 is connected in axially aligned, underlying relationship respective to swivel 30 by means of shaft 40, within which there is included the before mentioned lower orifice means 38 positioned therewithin so that outlet ports 42 located adjacent to face 44 of bit 16 are provided with spent compressible drilling fluid, whereupon cuttings 45 removed from formation 20 are carried back uphole through the annulus 18. Aquifer 46 is sometimes encountered and causes water to flow into annulus 18, thereby increasing the bottomhole pressure of the borehole.

A source of compressed fluid, S, such as air, flue gases, gaseous hydrocarbons, and any other suitable compressible fluid, hereinafter often referred to as a gas or gases, flows down the interior of pipe string 14, through the upper orifice 36, into the gas motor 22, where work is extracted from the gas and spent gases are then free to exhaust through conduits 32 and 34, where the gases are conducted into the swivel 30 and enter hollow shaft 28. The spent gases from shaft 28 are conducted through the lower orifice 38 and exit the drill bit 16 by means of outlets 42. The outlets 42 are sometimes called drill bit nozzles.

In order to remove formation cuttings from the bottom of the borehole, and to accommodate for variation in bottom hole pressure, the gases exiting the drill bit nozzles must be maintained at a sufficient pressure differential respective to the ambient to assure that fluids do not reflux and kill the well, a condition which can only occur when the critical downhole pressure is reached.

As formation water enters the borehole, the gas motor outlet is exposed to an increased pressure, which, in the absence of the present invention, would vary the pressure drop across the motor and thereby vary the output torque of the motor.

Figure 3:
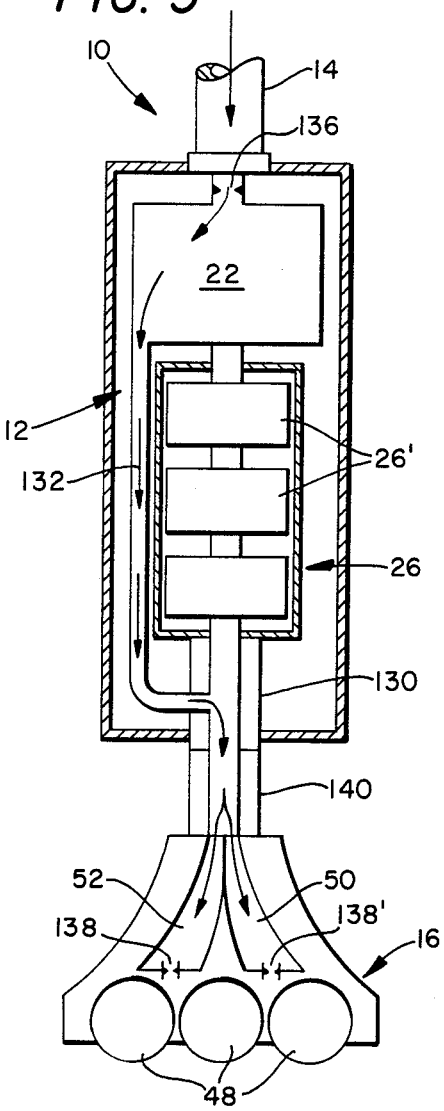

To eliminate this problem, gauged orifices are placed at the inlet to the motor (upper orifices, FIG. 3) and at the exit to the motor (lower orifices, either below the motor or at the air or gas exit from the bit, FIG. 3). These orifices are gauged to provide sonic flow conditions at the lower level and either sonic or subsonic flow conditions at the upper level. This will require a slightly higher injection pressure of air or gas to the drill string. The upper and lower orifices are gauged to allow a predetermined pressure drop across the downhole pneumatic motor and a predetermined flow of air or gas. This will ensure a constant horsepower output from the motor. Since sonic flow conditions will exist at the lower orifice, the bottom hole pressure is free to vary (within limits) with no change in motor output horsepower. Only when the bottom hole pressure increases to the critical ratio will the motor be affected by the bottom hole pressure variation. The injection pressure, therefore, the pressure drop through the upper and lower orifices can be set (by diameter of the orifices) such that the motor is unaffected by the bottom hole pressure variations for normal operating conditions.

EXAMPLE 1

A downhole gas driven motor is to develop 25 horsepower with an air flow of 1600 SCFM. The efficiency of the motor is to be about 50%.

The drilling rate is estimated to be 30 ft/hr. The downhole motor is to be used to drill hole from the surface to 5,000′ in depth with a $6\frac{1}{4}''$ bit.

Using the work of Angel, R. R. Angel, Volume Requirements For Air and Gas Drilling, Gulf Publishing Company, 1958, the bottom hole pressure, $P_b$, can be found for this 5,000′ depth from the following equation:

$$P_b = \left[ (P_s^2 + b\,T_{av}^2) e^{\frac{2ah}{T_{av}}} b\,T_{av}^2 \right]^{0.5}$$

which can be solved to obtain a value of 148 psia.

It is estimated that the bottom hole pressure can vary by as much as a factor of 2 higher than the 148 psia magnitude during normal drilling operations due to variations in drilling rate and to formation water which may enter the annulus; therefore, the maximum bottom hole pressure, $P_{dmax}$ could be 296 psi.

The critical relationship for sonic flow in a lower set nozzle(s) is:

$$\frac{p_2}{p_1} = \left(\frac{2}{k+1}\right)^{\frac{k}{k-1}}$$

where $p_1$ is the pressure above the nozzle (psia), $p_2$ is the pressure below the nozzle (psia), k is the ratio of specific heats of the gas (i.e., for air k=1.4).

For air, the above equation becomes:

$$p_2/p_1 = 0.5283.$$

If the nozzles at the bit (lower set) below the air motor are sized (i.e., diameter of openings) to require that the pressure above the bit nozzles be maintained at a level of pressure which will preclude its change even though the bottom hole pressure fluctuates between 148 psia and 296 psia, then pressure above the bit nozzles, $P_a$, must be $$p_a = 296/0.5283 = 560.3 \text{ psia.}$$

If there are three nozzle openings on the bit, then the diameter of these openings can be found from the following equation of J. K. Vennard, Elementary Fluid Mechanics, 4th Edition, Wiley & Sons, Inc., 1961, which is valid for sonic flow:

$$G = \left[\frac{kg}{R}\left(\frac{2}{k+1}\right)^{\frac{k+1}{k-1}}\right]^{0.5} \frac{A_2 P_1}{T_1^{0.5}}$$

which yields $A_2 = 0.0011$ ft$^2$, so the three nozzle openings at the bit must have a diameter of 0.2593 inches in order to maintain sonic flow conditions while the bottom hole pressure changes.

The pressure drop through the motor can be calculated by the following formula:

$$HP = \frac{\epsilon Q \gamma R T_{av}}{32976}\left(\frac{k}{k-1}\right)\left[1 - \left(\frac{p_{in}}{p_{out}}\right)^{\frac{k-1}{k}}\right]$$

This gives a calculated pressure drop through the motor of $P_{out}/P_{in} = 0.7536$ with $P_{in} = 743.5$ psia.

Since $P_{out}/P_{in}$ is greater than 0.5283, the following equation applies when calculating the orifice area:

$$G = A_2\left[\frac{2kg}{k-1} P_{in}\gamma_{in} \left| \left(\frac{P_{out}}{P_{in}}\right)^{\frac{2}{k}} - \left(\frac{P_2}{P_1}\right)^{\frac{k+1}{k}}\right.\right]^{0.5}$$

If $P_{out}/P_{in}$ were less than 0.5283, the sonic flow equation would be used to calculate the orifice area. This equation was used to calculate the lower orifice area.

By gauging the diameters of the nozzles above the air motor and below the air motor (bit nozzles) as above, the bottom hole pressure can vary by a factor of 2 higher than expected and the horsepower of the air motor will remain constant at 25.

If the bottom hole pressure decreases from the 148 psia level, the air motor will not be affected.

If the bottom hole pressure increases beyond the 296.0 psia level, the air motor horsepower will decrease in accordance with the pressure increase.

Those skilled in the art, having digested the above portions of this disclosure, should now appreciate that the following data should be known before accurate calculations can be made for selecting the proper orifice sizes:

(A) "G"—Amount of air being injected into the borehole;

(B) "γ"—The specific weight of the air;

(C) Size of the borehole to be drilled, and the pipe string diameter;

(D) Depth of the borehole;

(E) "ROP"—Rate of penetration (expected drilling rate);

(F) "K"—Specific heat of air;

(G) Temperature of air being injected into the borehole;

(H) Horsepower produced by the turbine.

Once the above initial conditions have been determined, the bottom hole pressure in the annulus is calculated by the following equation:

$$P_b = \left[(P_s^2 + b\,T_{av}^2)e^{\frac{2ah}{T_{av}}} b\,T_{av}^2\right]^{0.5}$$

The above equation is therefore the basis for the start of pressure drop regulation.

Bottom hole pressure will fluctuate with the change in characteristics of the returned cuttings along with the influx of water into the annulus. It is necessary to estimate the maximum bottom hole pressure. A reliable estimation is to initially add 100 psi to the calculated bottom hole pressure:

$$P_{new} = P_b + 100.$$

Sonic flow through the lower orifice is essential for the practice of this invention. When sonic flow exists in an orifice, a shock wave is created. This shock will isolate the pressure above the orifice from the pressure below the orifice. Stated differently, sonic flow through the lower orifice allows the bottom hole pressure to fluctuate within limits without affecting the pressure above the orifice, i.e., the exit pressure from the turbine.

The following terms are used to describe the pressure when referring to the upper and lower orifices:

$P_{1B}$=Pressure below upper orifice;

$P_{1A}$=Pressure above upper orifice;

$P_{2B}$=Pressure below lower orifice;

$P_{2A}$=Pressure above lower orifice.

Pressure drop through lower orifice: to assure sonic flow through the lower orifice, the following equation applies:

$$\frac{P_{2B}}{P_{2A}} = \left(\frac{2}{k+1}\right)^{\frac{k}{k-1}}$$

$$P_{2B} = P_{new}$$
$$k = 1.4$$

This reduces to:

$$P_{2B}/P_{2A} = 0.5283$$

The pressure above the lower orifice is given by:

$$P_{2A}=P_{2B}/0.5283$$

The orifice must be sized to meet the above conditions, which can be achieved by the following formula:

$$G=\left[\frac{k_g}{R}\left(\frac{2}{k+1}\right)^{\frac{k+1}{k-1}}\right]^{0.5}\frac{A_{2A}\,P_{2A}}{T_{2A}^{0.5}}$$

Solving the equation for the area of the orifice:

$$A=\frac{.5322(GT)^{0.5}}{P_{2A}}$$

Based on the initial conditions, only one orifice size can be calculated to meet these conditions.

The upper orifice size is determined in much the same manner as sizing the lower orifice. The pressure drop across the upper orifice is a function of turbine horsepower, and therefore the pressure drop across the orifice can be calculated by the following equation:

$$HP=\frac{\epsilon Q\gamma RT_{av}}{32976}\left(\frac{k}{k-1}\right)\left[1-\left(\frac{P_{1A}}{P_{1B}}\right)^{\frac{k-1}{k}}\right]$$

Pressure at the exhaust port of the turbine equals the pressure above the lower orifice. Therefore, since $P_{1B}=P_{2A}$ the equation for the pressure above the upper orifice may be solved as follows:

$$P_{1A}=\left[1-\frac{(HP)\,(177)}{\epsilon Q\gamma\,T_{av}}\right]^{3.5}[P_{2b}]$$

The orifice must be sized to meet the above conditions, and therefore the critical flow equation is employed:

$$P_{1B}/P_{1A}=0.5283$$

If $P_{1B}/P_{1A}$ is less than 0.5283, the following equation is used to determine orifice size:

$$A=\frac{0.5332(GT)^{0.5}}{P_{1A}}$$

If $P_{1B}/P_{1A}$ is greater than 0.5283, the following equation is used to determine orifice size:

$$A=\frac{G}{\left[225.4\,P_{1A}\,\gamma_{1A}\left(\frac{P_{1B}}{P_{1A}}\right)^{1.429}-\left(\frac{P_{1B}}{P_{1A}}\right)^{1.714}\right]^{0.5}}$$

Turbine horsepower requirement is a function of pressure drop across the upper orifice. If this pressure drop is above the critical pressure ratio, sonic flow equations must be used when calculating orifice size. Likewise, if the pressure drop is below the critical pressure ratio, subsonic flow equations apply when calculating orifice size.

From the above system of equations, it becomes apparent that, when the initial conditions are specified, only one set of orifice sizes can be calculated. If one were to estimate or guess at orifice size in order to use a shorter method, it is very unlikely that the orifices would function according to the method of the present invention.

SUBSONIC: SONIC: SUPERSONIC:

SONIC: The sharp rise in aerodynamic drag that occurs as the flow approaches the speed of sound. At supersonic flow rates, the flow rate exceeds the speed of sound; and, at sonic flow rates, the speed of sound is equal to the speed of the flowing material. Subsonic speed is a flow rate less than the speed of sound.

At any point in a duct through which air is flowing, the ratio of velocity to local wave speed (V/C) is called the Mach number M, which is the speed of sound, or sonic velocity. If M is less than 1, subsonic flow is realized. If the M is greater than 1, supersonic flow is realized.

I claim:

1. Method of drilling a borehole with a downhole pneumatically actuated motor supported by a pipe string wherein a drill bit is connected to be rotated by the pneumatic motor and the motor is located downhole adjacent to the bit, with gas flowing down the pipe string to the motor, and spent gas flowing up the borehole annulus, comprising the steps of:

(1) providing a first pressure differential between the motor inlet and the source of air pressure to cause sonic or subsonic flow to occur to the motor;

(2) providing a second pressure differential between the air motor outlet and the drill bit outlet to cause sonic flow to occur into the annulus;

(3) whereby; the pressure drop across the motor is substantially constant so long as the critical pressure at the drill bit outlet is not exceeded.

2. The method of claim 1 wherein said first pressure differential is effected by placing an upper orifice at the entrance to said motor; and, said second pressure differential is effected by placing a lower orifice within the drill bit passageway.

3. The method of claim 2 wherein the diameter ratio of the upper and lower orifices are gauged respective to one another and to the pipe string pressure to provide a pressure differential to the motor and sonic flow into the annulus.

4. The method of claim 3 wherein the pressure above the gas motor is high enough to maintain sonic flow across the lower orifice.

5. The method of claim 1 wherein the diameter ratio of the upper and lower orifices are of a value to provide sonic flow through the lower orifice and subsonic or sonic flow through the upper orifice, and further including the step of maintaining the pressure within the pipe string at a value which provides a bottom hole pressure in excess of the critical bottom hole pressure.

6. In a drilling operation, wherein gas is forced down a tubing string to a gas motor located in proximity of the bottom of a borehole, wherein the gas motor drives a drill bit and spent gases exit the bit and flow uphole through the borehole annulus; the method of achieving a constant power output from the gas motor according to the following steps:

(1) placing an upper orifice means upstream of the gas motor and placing a lower orifice means downstream of the gas motor;

(2) flowing gas from a source and down the tubing string, while maintaining the pressure above the gas motor at a value which is equal to the magnitude of the pressure drop across the gas motor and sufficient additional pressure to maintain sonic flow across the lower orifice at a maximum estimated bottomhole pressure.

7. The method of claim 6 wherein the upper orifice is placed at said motor inlet and said lower orifice is placed upstream of the drill bit exhaust ports.

8. The method of claim 7 wherein the pressure within the tubing string and the ratio of the diameter of the upper and lower orifices are of a value which causes sonic flow through the lower orifice and sonic or subsonic flow into the motor.

9. The method of claim 8 wherein the lower orifice is located within the drill bit passageways.

10. The method of claim 6 wherein the ratio of the diameter of the upper and lower orifices are of a value which enables sonic flow through the lower orifice and sonic or subsonic flow in the upper orifice;

and the lower orifice is located within the drill bit passageways.

11. In a drilling rig having a drill string, a source of gas connected to the upper end of the string, a gas motor connected to the lower end of the string, a drill bit connected to be rotated by said motor, the improvement comprising:

an upper orifice means located upstream of said motor, a lower orifice means located downstream of said motor, the diameter ratio of said upper and lower orifice means is of a value to admit sonic flow through the lower orifice and sonic or subsonic flow in the upper orifice;

whereby, the pressure drop across the motor is constant, thereby providing said motor with constant horsepower output.

* * * * *